United States Patent [19]

Bienfait

[11] 4,143,791

[45] Mar. 13, 1979

[54] APPARATUS FOR DELIVERING NEWSPAPERS, MAGAZINES AND SIMILAR ARTICLES

[76] Inventor: Henri P. Bienfait, 29 Insulindeweg, Delft, Netherlands

[21] Appl. No.: 817,067

[22] Filed: Jul. 19, 1977

[30] Foreign Application Priority Data

Dec. 8, 1976 [NL] Netherlands ..... 7613637

[51] Int. Cl.[2] ..... B65H 1/14

[52] U.S. Cl. ..... 221/75

[58] Field of Search ..... 221/75, 227, 279, 56–62, 221/41, 33, 36, 34; 194/63, 68

[56] References Cited

U.S. PATENT DOCUMENTS

| | | | |
|---|---|---|---|
| 482,824 | 9/1892 | Dain | 221/75 X |
| 991,130 | 5/1911 | Broemmelsiek | 221/34 |
| 3,057,511 | 10/1962 | Mannhardt | 221/75 |
| 3,203,589 | 8/1965 | Giepen | 221/75 |
| 3,464,588 | 9/1969 | Strike et al. | 221/75 |

*Primary Examiner*—Stanley H. Tollberg

*Attorney, Agent, or Firm*—Ladas, Parry, Von Gehr, Goldsmith & Deschamps

[57] ABSTRACT

A newspaper vending machine comprising a rectangular case having a filling opening for receiving newspapers, conveyor structure to advance the newspapers to a delivery slot through which the folded back of a newspaper is bent out and protruded to hand out the newspaper to a purchaser who has inserted the required coin amount.

1 Claim, 1 Drawing Figure

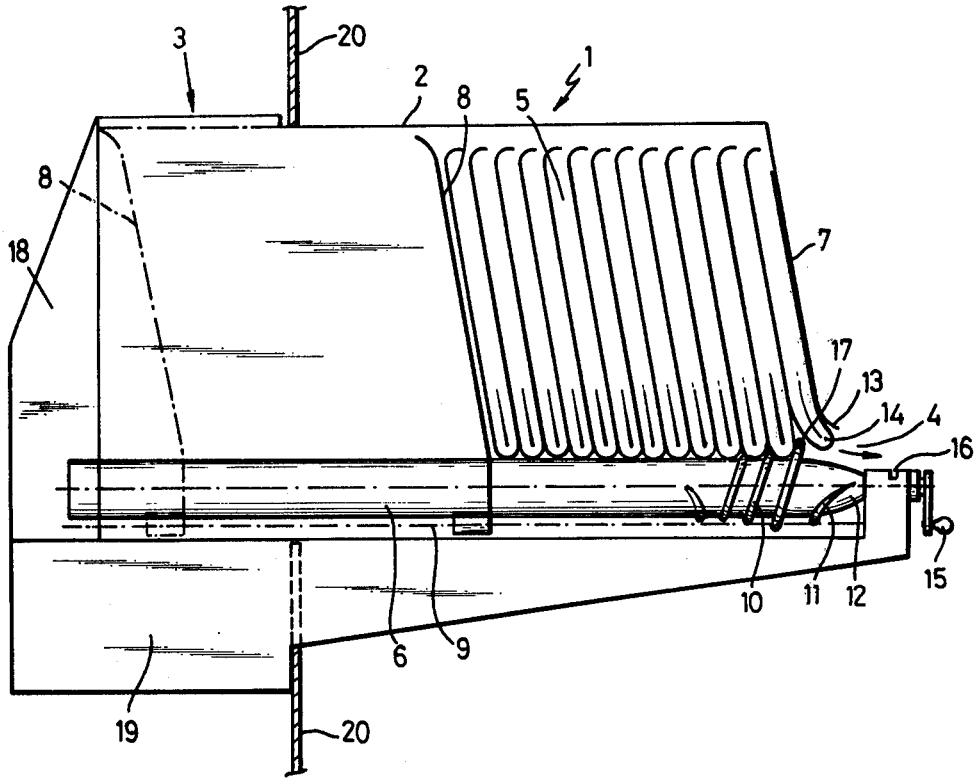
3
20
2
8
5
1
8
18
7
17
13
14
4
16
15
10
11
12
6
9
19
20

APPARATUS FOR DELIVERING NEWSPAPERS, MAGAZINES AND SIMILAR ARTICLES

BACKGROUND OF THE INVENTION

This invention relates to an apparatus for delivering newspapers, magazines and similar articles which are delivered one at a time when a purchaser has inserted the required coin or coins. Stripping newspapers from a stack, even from the top of a stack, is an operation which cannot readily be changed to an automatic process as a newspaper is not well suited to it because of the fact that it is limp and apt to be rumpled and torn. When stripping and pushing newspapers through a delivery slot, rumpled and torn newspapers would obstruct the passage and make the delivery of further newspapers impossible.

SUMMARY OF THE INVENTION

It is an object of the present invention to overcome said problem by providing an apparatus comprising a substantially closed rectangular case having a filling opening through which a row of newspapers is to be received within the case, and a delivery slot, and provided with means which are effective after having inserted the coin as required so that the bent-out backfold of a newspaper will protrude from the delivery slot and the purchase can withdraw a newspaper from the case.

A preferred embodiment is characterized in that said means include at least one guide roll extending from the filling opening to the delivery slot, said roll being adapted to support a row of newspapers standing on their backfold, and being provided, adjacent the delivery slot, with a screw groove in which the backfold of a newspaper is to be engaged and conveyed, and with a tapered end on which, guided by the screw groove end, the act of bending out and protruding the backfold of a newspaper through the delivery slot takes place. Said protruding action is favored by the fact that the front plate of the case is downwardly inclined to the delivery slot and thereat forms with an outwardly rounded lower edge the top of the slot, opposite to the tapered end of the guide roll, and a biasing means retaining the row of newspaper onto the inclined front plate of the case, and by operating an actuating crank, the screw groove can each time be turned through one revolution after having inserted the coin as required for the delivery of one newspaper.

The newspaper readers are now capable of stripping their newspaper themselves and there is not much danger for obstructions, and moreover, according to a further aspect provisions are made to the effect that after having inserted the coin as required, only one newspaper can be withdrawn from the case, but one cannot reach the further newspapers as the terminal screw winding is first so deep and then runs out over such a length that it is not possible to remove a newspaper which is engaged by the screw groove.

The invention is described in more detail in the following specification with reference to the drawing, in which the invention is illustrated.

BRIEF DESCRIPTION OF THE DRAWING

The single FIGURE schematically shows, in elevation and longitudinal section, a preferred embodiment of the newspaper delivering apparatus.

DESCRIPTION OF THE PREFERRED EMBODIMENT

The newspaper delivering apparatus which is generally indicated with the reference numeral 1 in the drawing, is provided with an elongated, substantially rectangular closed case 2 having a filling opening 3 and a delivery slot 4. The row of newspapers 5, standing on their backfold, is supported on at least one guide roll 6, and retained onto the front plate 7 of the case 2, which is downwardly inclined to the delivery slot 4, by a biasing means 8 which as indicated in the drawing by the arrow is uniformly advanced by the screw drive 9 schematically indicated with a phantom line, when delivering a newspaper. As an alternative, the biasing means could be oppressed and advanced by a spring.

Adjacent the delivery slot 4 the guide roll 6 is provided with a screw groove 10 having such a pitch that it can engage and advance a newspaper 5 for the delivery, and a run-out 11 to a tapered end 12 of the guide roll 6. Opposite said tapered end 12 the lower edge 13 of the front plate 7 of the case 2 is outwardly rounded so that the backfold 14 of a newspaper 5 to be delivered, which is bent out by the run-out 11, is protruded from the delivery slot 4, and the newspaper is then easily withdrawn from the case.

The guide roll 6 is adapted to be driven by a crank handle 15 which after having inserted the required coin through the coin slot 16 can be turned through one revolution for delivering one newspaper from the screw groove 10. At the same time the removal of further newspapers is prevented by the deep screwthread 17 as illustrated and a run-out 11 which is extended so that one cannot easily reach so far in the case.

Preferably a pair of guide rolls 6 are arranged so that the newspapers are well supported on each side, said guide rolls being uniformly driven at the delivery by a gear mechanism (not shown) in the gear box 18.

The gear box 18 and the money drawer 19 are preferably located behind the wall 20 through which the front part of the case 2 projects.

Finally it is observed that the apparatus as represented here is of course subject to variations and changes without departing from the scope of this invention.

What is claimed is:

1. In apparatus for delivering newspapers, magazines and similar articles, which are delivered one at a time therefrom when a purchaser has inserted the required coin or coins, having a substantially closed rectangular case for holding a row of newspapers, a delivery slot, and screw means operative, after insertion of the coin as required, to move a newspaper towards the delivery slot to thereby enable a purchaser to withdraw the newspaper from the case, wherein the improvement comprises:

(1) a downwardly inclined plate at the front of the case terminating in the delivery slot;

(2) a filling opening at the rear of the case;

(3) a conveyor screw extending substantially the full length of the case from the rear to a point below the delivery slot and adapted to support a row of newspapers standing on their backfolds;

(4) biasing means advanced by the conveyor screw and bearing against the rear most in the row of newspapers to keep the papers upright and force the foremost paper towards the delivery slot;

(5) the front plate at its lower edge forming one side of the delivery slot being formed with an outwardly rounded lower edge; and (6) the conveyor screw is formed with a helical groove engaging the backfold of the newspapers and the leading end of the conveyor screw is tapered, the arrangement being such that the leading newspaper is delivered with its backfold being pushed out through the delivery slot so that it can be easily grasped and withdrawn from the case, and the depth of the helical groove being such to prevent removal of any further paper for which coins have not been inserted.

* * * * *